United States Patent [19]

Carmona

[11] Patent Number: 5,059,944

[45] Date of Patent: Oct. 22, 1991

[54] TENNIS COURT BOUNDARY SENSOR

[76] Inventor: Pedro M. Carmona, Avenida San Jeronimo 1006-8, San Jeronimo Lidice, Delegacion Magdalena Contreras, Mexico, D. F., Mexico

[21] Appl. No.: 389,065

[22] Filed: Aug. 2, 1989

[51] Int. Cl.[5] ..... A63B 61/00

[52] U.S. Cl. ..... 340/323 R; 273/29 R

[58] Field of Search ..... 273/29 R, 31, 411, 54 E; 340/323 R, 556; 250/222.1; 364/410

[56] References Cited

U.S. PATENT DOCUMENTS

| | | | |
|---|---|---|---|
| 3,415,517 | 12/1968 | Krist . | |
| 3,883,860 | 5/1975 | Von Kohorn . | |
| 3,982,759 | 9/1976 | Grant | 273/31 |
| 4,004,805 | 1/1977 | Chen et al. | 273/29 R |
| 4,092,634 | 5/1978 | Von Kohorn . | |
| 4,109,911 | 8/1978 | Van Auken . | |
| 4,183,056 | 1/1980 | Evans et al. . | |
| 4,266,124 | 5/1981 | Weber et al. | 340/556 X |
| 4,365,805 | 12/1982 | Levine . | |
| 4,375,289 | 3/1983 | Schmall et al. . | |
| 4,422,647 | 12/1983 | Wilson et al. | 340/323 R X |
| 4,432,058 | 2/1984 | Supran . | |
| 4,528,548 | 7/1985 | Oberan | 340/323 R |
| 4,664,376 | 5/1987 | Gray . | |
| 4,814,986 | 3/1989 | Spielman | 364/410 |
| 4,867,449 | 9/1989 | Carlton et al. | 273/29 R |

*Primary Examiner*—Joseph A. Orsino
*Assistant Examiner*—Brian R. Tumm
*Attorney, Agent, or Firm*—Knobbe, Martens, Olson & Bear

[57] ABSTRACT

Optical system for detecting and signaling a ball out-of-bounds condition on a tennis court. An optical shape plane interfered by a tennis player disables an underlying optical timed plane. The timed plane discriminates between an interference caused by a player's foot or a tennis ball. The optical planes are produced by emitter and receptor sensor units which surround the tennis court. The sensor units may be configured around the tennis court in sets of units referred to as optical lattices. Each optical lattice provides intersecting light beams allowing for continuity in court coverage when a player disables a timed plane. An out-of-bounds ball is signalled by an audiovisual device.

26 Claims, 8 Drawing Sheets

| BEAM STATUS \ BEAM NUMBER | 162 | 164 | 166 | 168 | 170 | CALL |
|---|---|---|---|---|---|---|
| | CLEAR | × | × | × | × | — |
| | BLOCK | × | × | × | × | — |
| | BOUNCE | CLEAR | CLEAR | CLEAR | × | — |
| | BOUNCE | BOUNCE | × | × | × | OUT |
| | BOUNCE | × | BOUNCE | × | × | OUT |
| | BOUNCE | × | × | BOUNCE | × | OUT |
| | BOUNCE | × | × | × | BOUNCE | — |

| | |
|---|---|
| CLEAR | UNOBSTRUCTED BEAM |
| BLOCK | BEAM OBSTRUCTED BY PLAYER |
| BOUNCE | BEAM OBSTRUCTED BY BALL |
| × | DON'T CARE |

Fig. 3

TENNIS COURT BOUNDARY SENSOR

BACKGROUND OF THE INVENTION

1. Field of the Invention

The present invention generally relates to out-of-bounds sensors and, more particularly, to optical tennis court boundary sensors.

2. Description of the Prior Art

Tennis is a recreational activity played on a rectangular tennis court with a net separating opposing players, or sides. The number of players on the tennis court varies depending on whether the game is singles or doubles tennis. In singles tennis, each side is composed of one player and, in doubles tennis, each side is composed of two players.

In the most basic description of the game, tennis players use tennis rackets to hit a tennis ball back and forth across the net. The tennis ball is hit until a player fails to return a tennis ball over the net and inside the tennis court boundaries, which are defined by various lines, including sidelines, baselines, service lines and a center line.

Tennis is a sport, among a number of sports, in which fans pay money to watch professional tennis players compete, and, consequently, cash awards are offered to the winning competitors. Amateur tennis, however, is an extremely popular game in its own right, played by millions of people throughout the world. In amateur tennis, the players typically keep score themselves and decide when a ball lands outside the boundaries of the tennis court. Hence, during service of the tennis ball, each player must monitor all service court lines. After service, only the sidelines and the baselines need be observed.

In contrast to amateur tennis, professional tennis matches, referred to as tournaments, require impartial officials to call balls as in or out-of-bounds. At such a tournament (one of the more famous tournaments is that hosted in Wimbledon, England every year), a chair umpire sits on a high chair overlooking the players and the court. The chair umpire functions as the ultimate authority over a squad of linesmen who watch the court lines and call balls. A full complement of linesmen includes, on each side of the court, a service line-linesman, a baseline-linesman, a center line-linesman, and two sideline-linesmen. Therefore, a complete squad of tennis officials comprises a chair umpire and ten linesmen. In addition, most tournaments will have a net umpire, and some tournaments will even have a foot fault judge. With so many officials monitoring lines for out-of-bounds balls, the tennis players on the court must indeed feel overwhelmed!

Amateur players, by contrast, having no impartial observers to watch the lines, must make out-of-bounds calls themselves. Such judgment calls are inherently imprecise, and may even be unfair. In general, the tennis player on the side of the court where the ball lands is best able to see if the ball is out-of-bounds. Thus, even if unintentional, players have an unconscious bias to call close balls as out-of-bounds. Moreover, players naturally tend to concentrate more on making contact with an in-flight tennis ball, rather than on watching where a passed ball lands.

Of course, in professional play, lack of concentration by a linesman may also lead to inaccurate calls. This conclusion becomes all the more evident when one considers the context of professional play which includes high speed imparted on tennis balls by professional players, and a variety of spins, bounces and skidding balls found in such hard-hitting games. It should be noted that at international tournaments the consequences of one bad call can be, not only the loss of a cash award, but also a lost opportunity for future revenue generated from promoting consumer products. Clearly then, amateur and professional players invariably would prefer consistent and precise calls provided by automated boundary sensors, over the caprices of human error.

Nonetheless, for a number of years now, precision out-of-bounds sensors have been a continuing holy grail. Many groups have tried to solve the out-of-bounds dilemma by either placing sensors adjacent to the tennis court boundary lines on the court, or immediately under the court. For example, pressure sensitive switches can be installed beneath tennis court boundary lines. The network of switches, upon detecting a downward force, cause a small current to drive a relay connected to an audiovisual signalling device. As another example, special semi-metallic balls can be manufactured to function in combination with electromagnetic line sensors such as conductive and magnetic stripes. Closely spaced leads are affected by contact with the special ball and cause an audiovisual device to signal an out-of-bounds condition.

The principal drawback of the pressure switch system is that individual sensors cannot be calibrated to discriminate between a bouncing ball and a player's foot. Alternatively, the inconvenience of using a special ball, in conjunction with the cost of permanently modifying a tennis court, are burdensome hurdles to leap for most potential users of the electromagnetic sensor systems.

More recently, optical out-of-bounds sensors have been disclosed which employ interruptions in light beams to detect out-of-bounds balls. The patent to Grant (U.S. Pat. No. 3,982,759), for instance, describes a linemonitoring apparatus which can be implemented using pressure switches or light interference detectors. According to the Grant patent, a timing circuit measures the length of time that laser light is interrupted, and if the interference is for longer than 50 milliseconds, the sensor assumes that the interference is due to a player. Oberan (U.S. Pat. No. 4,528,548) discloses another kind of optical out-of-bounds sensor for racquetball or handball. The Oberan patent is similar to Grant since it uses a timer to time the interruption of the light beam, and thereby discriminate between a player's foot and a tennis ball.

Other out-of-bounds systems have used more than one light beam to distinguish between a foot and a ball interruption. Chen, et al., (U.S. Pat. No. 4,004,805), shows a dual beam laser which, used in combination with a system of mirrors, completely surrounds the tennis court boundaries. The dual light beams include an inner, timed beam, inside the tennis court boundary line, and an outer, untimed beam, outside the tennis court boundary. The sensor discriminates the type of beam interruption by either detecting a long period of inner beam interference, and assuming the interference was made by a foot, or presuming a foot interference when both beams are interrupted for a short period, but almost simultaneously. Only when the outer beam is momentarily interrupted is an out-of-bounds indication made.

As yet another example of a dual light beam system, Wilson, et al., (U.S. Pat. No. 4,422,647), discloses an out-of-bounds detection system for a volleyball court. Wilson, et al., shows a top light beam, located parallel to a bottom light beam positioned over each court line. An edge-sensitive timer circuit measures the duration of a light beam interference; when the top beam is broken, the timer is reset and the bottom beam triggers on a negative edge from a HIGH voltage (not broken) to a LOW voltage (broken). Thus, when the top photo-transistor is HIGH (not broken), and the bottom light beam goes LOW (broken), the timer starts a count-down until either time expires or the timer is reset. If the top beam goes LOW (broken), then the timer is reset and an LED, indicating an out-of-bounds ball, goes off.

Upon close inspection of these prior technologies, serious shortcomings are evident. The pressure and electromagnetic sensors of the prior technologies require extensive permanent equipment to be embedded in the court, and sometimes such systems even require a special ball. Optical sensors have their own unique problems, and they also share some common problems with non-optical sensors. For example, in Grant, the fact that the tennis court boundary is protected by a single beam width means that hopping or skidding balls, as typically found on clay courts, are detected as foot interferences. The Wilson system has a similar problem; however, Wilson has an advantage that one beam is high enough above the ground to detect foot interruptions. The deficiency in Wilson seems to be that the timer requires exact simultaneous interruption of both beams for the system to not trigger an out-of-bounds condition.

A common shortcoming of all the current technology optical sensors is that tennis boundary coverage is not sustained when a foot interferes with a light beam, since the interruption by the foot, causing a long pulse, will overlap in time the short pulse caused by a ball.

Consequently, a need exists for improvements in tennis court out-of-bounds sensors which will result in an absence of extensive permanent tennis court equipment, a multi-beam coverage for each boundary line, an improved mechanism to distinguish player interferences from ball interferences, and a means to sustain tennis court coverage when players interfere with light beams.

SUMMARY OF THE INVENTION

The present invention provides a tennis court boundary sensor apparatus and method designed to satisfy the aforementioned needs. The invention comprises a dual-plane light array, including a shape plane and a timed plane, enabling logic to enable the timed plane when the shape plane is unperturbed, a timing circuit to time a disruption in the timed plane, a validity logic module to ensure that an out-of-bounds decision occurs only when a proper combination of beams are interrupted, and an output circuit to notify court participants when a ball is out-of-bounds.

More specifically, in one preferred embodiment of the present invention, a plurality of sensor units surround a tennis court. The sensor units function in pairs made up of one emitter and one receptor sensor unit. The emitter sensor unit has a horizontal array of infrared LEDs which generate shape light beams (to detect the presence of a portion of a player's body), and also, positioned in the unit beneath the shape array, a horizontal array of infrared LEDs which generate timed light beams. Each one of the light beams discussed is pulsed by a corresponding circuit comprising an oscillator, and each light beam is focused by a collimating lens.

The receptor sensor unit includes a plurality of collimating lenses and phototransistors which are positioned in the receptor sensor unit chassis symmetrically to the collimating lenses located in the emitter sensor unit. A plurality of timed beam pulse shaper circuits each provide an input to a corresponding timing circuit. The timing circuit is enabled by a timing enable signal received from a validity logic module. When the timing circuit is enabled as a result of an object passing through the light beam, a light beam interference is timed, and if it is of sufficiently short duration, an output pulse is provided to the validity logic module. The validity logic module receives inputs from a plurality of shape beam pulse shaper circuits. If a shape beam is interfered by a player, then the timing circuit and an output circuit are disabled. However, when the timing circuit and the output circuit are enabled, a ball which interferes a timed beam causes an output device in the output circuit to signal a ball out-of-bounds condition.

The sensor units may be placed on the tennis court so as to cause the light beams to be in alignment with the tennis court boundaries. However, in a more sophisticated embodiment, the sensor units may be configured as an optical lattice. The optical lattice may be configured around all tennis court lines in use; however, for practical purposes, protection of the baselines is sufficient for most tennis games. The optical lattice comprises three sets of intersecting light beams, a set of light beams parallel and outside the protected line, a set of light beams forming a "negative slope" diagonal stripe, and a set forming a "positive slope" diagonal stripe. The two diagonal sets of light beams are diagonal with respect to the line being protected. Thus, at any point in the protected area, three timed beams intersect.

A player perturbing a shape beam, will generally only disable one set of timed beams, and a ball landing out-of-bounds, close to the player, will still be detected by the remaining two intersecting time beams. Such a configuration necessarily requires a more robust validity logic module, and, in fact, the validity logic module may reside in a separate chassis with the power supply, or the module may be placed in a special, or master, receptor sensor unit.

The present out-of-bounds sensor does not require permanent equipment to be installed in a tennis court, and it can be adapted in a cost effective manner to serve the needs of all types of tennis courts including private courts, tennis club courts and tournament courts. The dual-plane light array, and the timing circuit coupled to one of the planes, prove to be a superior means of detecting out-of-bounds balls without generating false alarms caused when one or more beams are interrupted by a tennis player. The optical lattice sensor configuration also sustains court coverage, even when a player obstructs the path of a light beam.

These and other objects and features of the present invention will become more fully apparent from the following description and appended claims taken in conjunction with the accompanying drawings.

BRIEF DESCRIPTION OF THE DRAWINGS

FIG. 3 is a logic table, used in conjunction with the lattice of FIG. 2, having columns identified by beam number and call, and rows identified by beam status.

DESCRIPTION OF THE PREFERRED EMBODIMENTS

Reference is now made to the drawings wherein like parts are designated with like numerals throughout.

Figure 1:
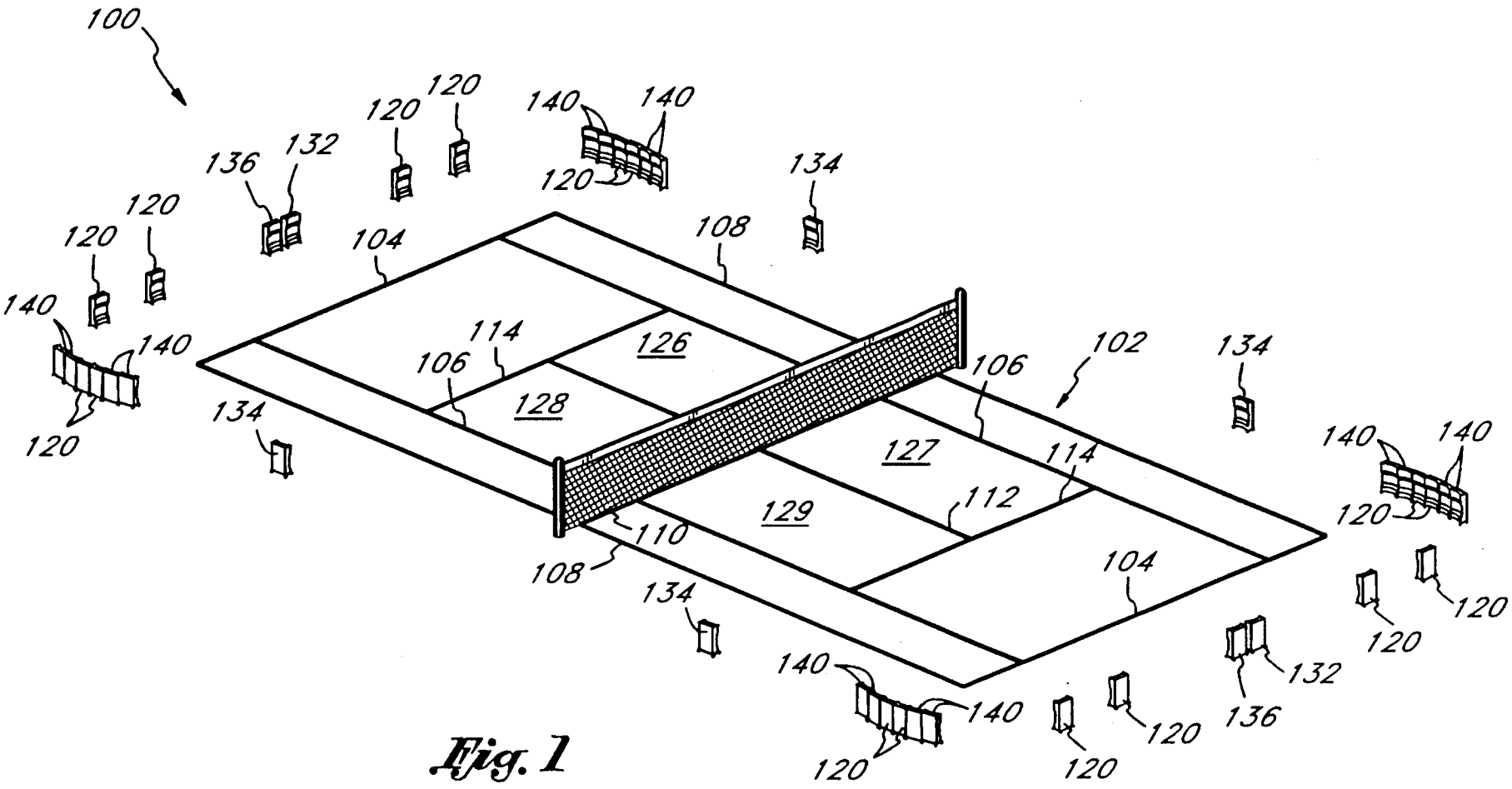
FIG. 1 is a perspective view of one presently preferred embodiment of the invention, illustrating a tennis court surrounded by sensor units configured to detect tennis ball out-of-bound conditions.

FIG. 1 shows a boundary sensor system 100 for signaling a ball out-of-bounds condition. The boundary sensor system 100 is located on a tennis court 102 having boundaries defined by a set of boundary lines as follows: baselines 104, singles sidelines 106, doubles sidelines 108, net line 110, center line 112 and service lines 114.

In this preferred embodiment, the boundary sensor system 100 is configured on a tennis court. However, the boundary sensor system 100 may be readily adapted to a variety of games requiring a ball court. The discussion henceforth assumes a boundary sensor system configured on a tennis court, but the tennis court should be understood as only one possible embodiment of the boundary sensor system 100.

The boundary sensor system 100 comprises a plurality of sensor units 120 which surround the tennis court 102. Sensor units with reference numerals other than "120" are also shown in FIG. 1. However, it should be understood that these sensor units differ from the sensor units 120 only in their placement around the tennis court 102. The sensor units 120 function in pairs of units. A pair of sensor units 120 comprises an emitter sensor unit 122 (see FIG. 6) and a receptor sensor unit 124 (see FIG. 7). The sensor unit pairs 122, 124 are optical devices which include a means for transmitting and receiving light beams, and a means for timing interference patterns. One example of a means for transmitting a light beam is a laser.

During play, sensor units 120 associated with tennis court boundary lines are active. For example, in a singles game, only the sensor units 120 which parallel the baselines 104 and singles sidelines 106 are active. During service, additional sensor units are made active. For instance, when service is made into an upper right service court 126, left center line sensors 136 and upper service line sensors 134 are active. For service in either an upper left service court 128, or a lower left service court 129, right center line sensors 132 must be active. Again, for each pair of sensors such as 132, 134 or 136, one of the pair is an emitter sensor unit 122 while the other is a receptor sensor unit 124. The particular characteristics and operation of each of these sensor types will be more fully explained hereinafter with reference to FIGS. 6 and 7.

Normally, the sensor units 120 are placed such that light beams transmitted between sensor pairs are parallel and adjacent to the outer edges of the respective tennis court lines. Of course, the outer edge of the center line 112 changes depending upon which side of the court, the right or the left, service is made into, and hence, there are two pairs of sensor units 120 for the center line 112, a set of right and left center line sensors 132, 136.

When a tennis ball (not shown) interferes with a light beam (not shown) between a pair of sensor units, circuitry coupled to the receptor sensor unit will cause an output device such as a light, buzzer or like audiovisual device (not shown), to signal that the ball is out-of-bounds.

A plurality of optical lattice sensor units 140 are configured to transmit light beams which intersect the baselines 104. The optical lattice sensor units 140 comprise a grouping of sensor units 120 which are organized into a configuration that forms an optical lattice 142 (shown in FIG. 2) behind each baseline 104. The optical lattices 142 are placed behind the baselines 104, in the boundary sensor system 100 illustrated in FIG. 1, since the vast majority of out-of-bound calls are made at the baselines 104. However, in other embodiments of the boundary sensor system 100, the optical lattice sensor units 140 may be positioned around any number of tennis court boundary lines.

Figure 2:
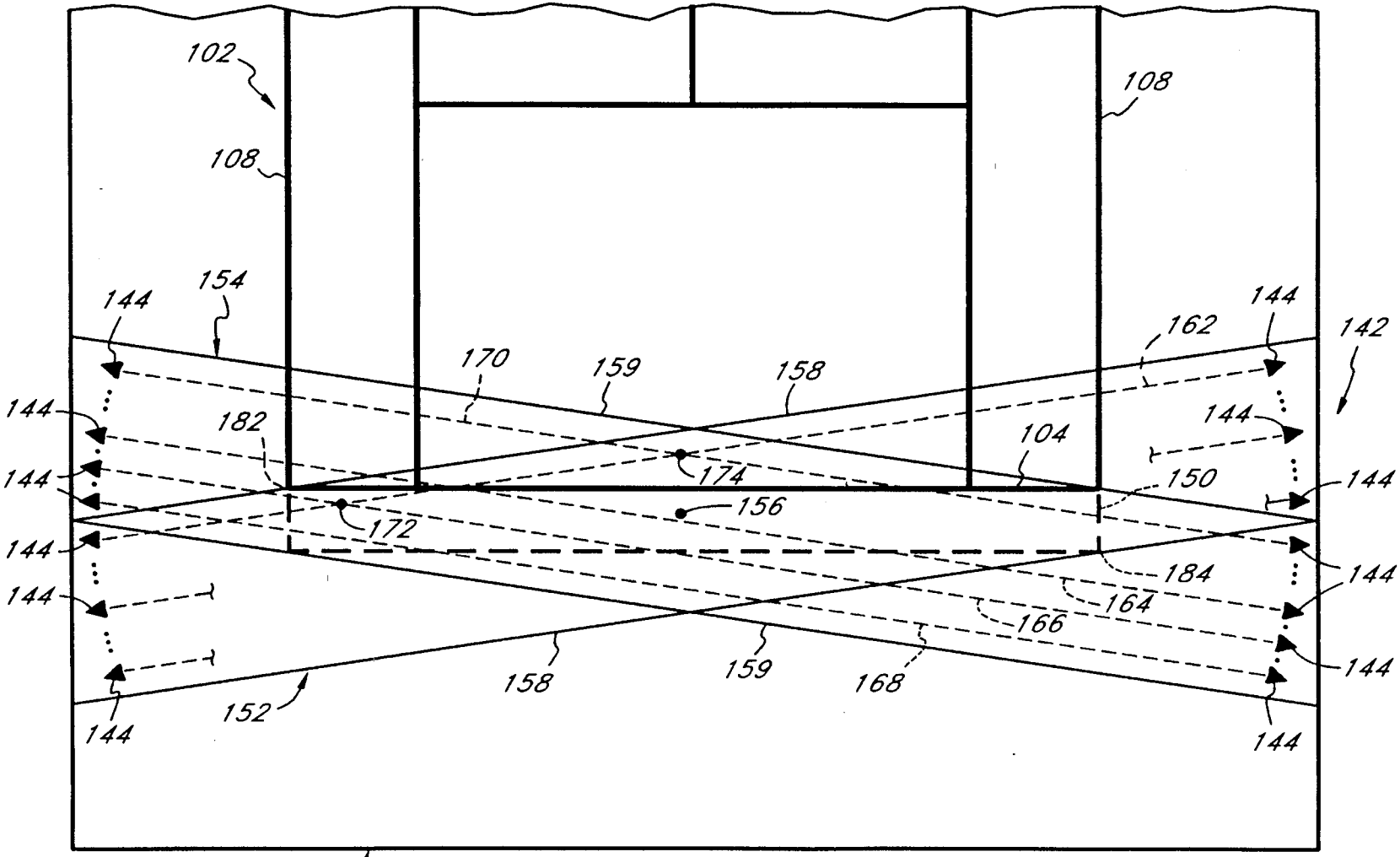
FIG. 2 is a partial plan view of a tennis court, and an out-of-bounds protected area adjacent to a baseline of the tennis court,. partially overlaid by a portion of one preferred embodiment of an optical lattice shown in phantom.

Turning now to FIG. 2, an enlarged portion of the optical lattice 142 is shown overlaying the tennis court 102. The portion is shown with light beams spaced apart in exaggerated form for purposes of illustration. Also, for the sake of visual clarity, the portion of the optical lattice 142 shown in FIG. 2 does not include the light beams running parallel to the baseline 104. Furthermore, the housings of the sensor units 120 shown in FIG. 1 have been replaced by a plurality of individual sensors 144 to simplify FIG. 2.

An out-of-bounds protected area generally indicated at 150 is shown adjacent to the tennis court baseline 104, but outside of the tennis court 102. The depth of the out-of-bounds protected area 150, located behind the baseline 104, is a parameter subject to the desire of the contestants. However, as an example, a depth of 17 cm. has been shown to be adequate for most tennis games.

The optical lattice portion 142 overlaying the out-of-bounds protected area 150 is a diamond shape formed by the intersection of two skewed parallelograms. The skewed parallelograms are referred to as a positive slope stripe generally indicated at 152 and a negative slope stripe generally indicated at 154. The stripes 152,154 intersect around a centroid 156 common to each stripe 152, 154 and the out-of-bounds protected area 150. The positive slope stripe 152 is enclosed by a pair of stripe boundaries 158, and the negative slope stripe 154 is enclosed by a pair of stripe boundaries 159. Light beams such as that shown at 162, run parallel to the stripe boundaries 158 which define the positive slope stripe 152. Other light beams such as those shown at 164, 166, 168 and 170 run parallel to the stripe boundaries 159 which define the negative slope stripe 154. In a separate stripe (not shown), light beams run parallel to the baseline 104 and are confined inside of the out-of-bounds protected area 150. Therefore, at a point such as light beam intersection 172, three light beams intersect, although only two intersecting light beams are shown.

Each light beam is defined by a pair of optical sensors 144, one optical sensor 144 located inside one of the emitter sensor units 122 and the other optical sensor 144 located inside one of the receptor sensor units 124. The width of the stripes 152, 154 and the spacing, or density, of the beams determines the number of light beams, and thus the number of optical sensors 144, required in the optical lattice 142. All of the light beams, which are generated by the boundary sensor system 100 to detect out-of-bounds balls, are positioned near the surface of the tennis court 102 where a ball contacting the surface can be detected.

A set of light beams in a portion of a stripe of the optical lattice 142 are disabled when a player is in the stripe. This occurs because part of the player's body (i.e., a leg or foot) breaks the beam and prevents its transmission from a sensor to a corresponding receiver. Because of the angular orientation of the different beams, in general, only one of the three sets of light beams at any particular intersection will be disabled by a player in the vicinity.

For instance, a player standing at a light beam intersection 174 will disable the light beam 162. However, if a ball lands at light beam intersection 172, at the same time that light beam 162 is disabled, the light beam 166 will still be enabled, as will a second light beam (not shown) running parallel to the baseline 104 and intersecting the point 172. So a ball landing out-of-bounds will be detected by interfering with just two beams, since the light beams are most optimally spaced about one tennis ball diameter apart. However, not all light beam intersections that are interfered will be out-of-bounds due to the fact that the diagonal stripes 152, 154 also cross in the area inside of the tennis court boundaries. For example, the light beam intersection 174 is not out-of-bounds.

Whether a ball interfering with light beams is out-of-bounds or not can be determined from a logic table, such as the one shown in FIG. 3 for light beams 162, 164, 166, 168 and 170. In the table, the first five columns correspond to each light beam number. The last column of the table is the resulting call, i.e., whether the ball is out-of-bounds. The rows of the table indicate the status of each light beam. Light beams are defined to be in one of three states as follows: "CLEAR", meaning the beam is unobstructed; "BLOCK", meaning the beam is obstructed by a player; "BOUNCE" meaning the beam is obstructed by a ball. In addition, an "X" indicates a "don't care" state, or that the light beam may be in any one of the above-listed states. To understand the table, two examples are now presented. When the light beam 162 is interfered by a ball, and the light beam 164 is simultaneously interfered by the ball, an OUT call is made. However, if a ball interferes with the light beam 162, and the ball simultaneously interferes with the light beam 170, an OUT call is not made since the light beam intersection 174 is in-bounds.

The optical lattice 142 described by FIGS. 2 and 3 is an example of the lattice structure used in the present invention, and the optical lattice 142 is presented to understand its operation. The optimal placement of the optical lattice sensor units 140 in an optical lattice 142 although not shown will now be discussed. Assume first that the diameter of a tennis ball is about 5 cm., then to maintain perfect coverage on a tennis court the distance between parallel light beams must also be a maximum of 5 cm. This distance may alternatively be formulated as a beam density which, for the case of a tennis ball, is 20 beams per meter. It is also known that, for doubles tennis, the length of the baseline 104 between doubles sidelines 108 is, $a = 10.97$ meters, and a typical distance from the doubles sideline 108 to a playing surface perimeter 180 is, $b = 2$ meters. One must choose a depth of the out-of-bounds protected area 150 and, from experience as noted above, a depth of around 17 cm. is adequate for most types of tennis play.

With respect to the positive slope stripe 152, it is clear that its stripe boundaries 158 must pass through an upper left corner 182 and a lower right corner 184 of the out-of-bounds protected area 150. It is also clear that the steeper the slope of the positive slope stripe 152, and the greater the depth of the out-of-bounds protected area 150, the greater must be the width of the stripe 152, and, therefore, the greater the number of light beams that are required. The same argument also applies to the negative slope stripe 154. Thus, to minimize the number of light beams, it is preferable that the stripes 152, 154 have a minimal absolute slope. However, the minimal absolute slope is bounded from below by the distance between light beam intersections. For a given beam density, as the absolute slope tends towards the horizontal, the width of the stripe narrows and the spacing between light beam intersections distorts to where beam distances from the vertical become greater than 5 cm. and beam distances from the horizontal become less than 5 cm. Thus, to maintain detection accuracy in the vertical direction, a higher beam density is required causing an increase in the number of optical sensors 144.

It has been found that this slope, or angle, should be in the range of about $5° \leqq \beta \leqq 20°$. An angle outside of this range causes an inefficiency due to the larger number of required optical sensors 144 as discussed above. Choosing $\beta = 8.53°$ for the stripes 152, 154 provides a stripe width of $f = (a + 2b)\tan\beta = 2.24$ meters. Given the required beam density calculated above, 20 beams per meter, the number of beams required in this example would just be the result of multiplying the beam density by the stripe width to arrive at 44.91 light beams. Assuming, again, four light beams per pair of sensor units 120, then eleven pairs of sensor units 120 would be required to cover each stripe 152, 154. Since, in this example, there are two stripes 152, 154 for each baseline 104, and since there are two base lines 104, a complete configuration of optical lattice sensor units 140 to form the stripes 152, 154 would require forty-four pairs of sensor units 120. In addition, the depth of the out-of-bounds protected areas 150 requires N additional light beams parallel to each baseline 104. This requires N pairs of sensor units 120 for each base line 104. Accordingly, complete coverage of each out-of-bounds protected area 150 requires $N + 22$ pairs of sensor units 120, or $2N + 44$ pairs of sensor units 120 to cover both baselines 104. The number of light beams N can be determined by multiplying the beam density by the depth of the out-of-bounds protected area 150. For example, given a beam density of 20 beams per meter and a depth of 17 cm., $N = 3.4$.

Figure 4:
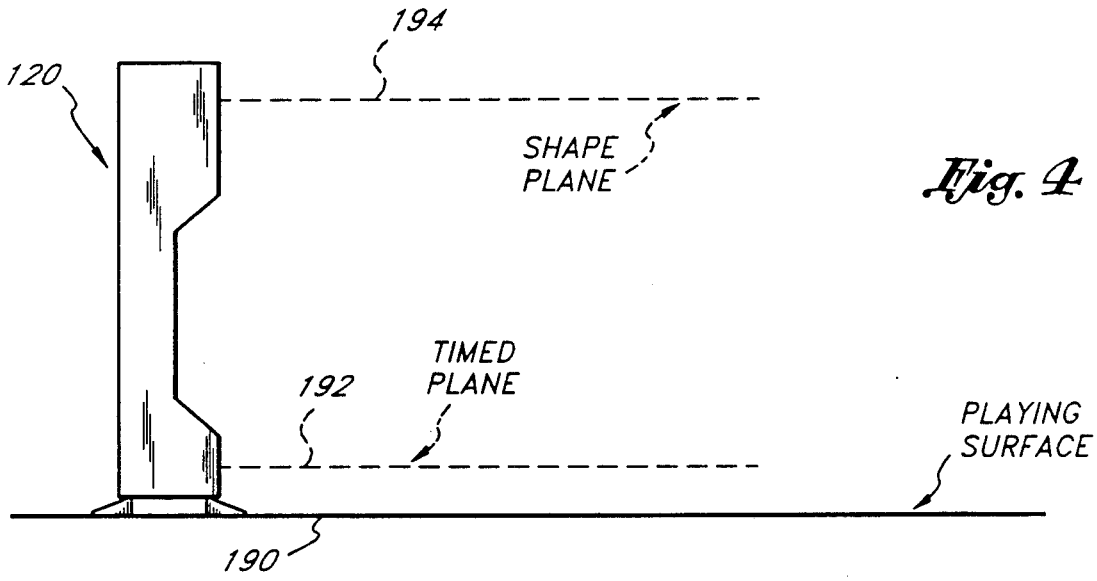
FIG. 4 is a side elevational view of one preferred embodiment of a sensor unit, with its light beams, shown in phantom, define a timed plane and a shape plane.

FIG. 4 presents a side view of one preferred embodiment of a sensor unit 120. The sensor unit 120 stands on a playing surface 190. A timed light plane 192, comprising light beams generated by the sensor unit 120, is shown running parallel and proximate to the playing surface 190. The height of this timed plane 192 from the playing surface 190 is dependent upon the diameter of a tennis ball and should be no higher than such diameter. A shape light plane 194, also generated by the sensor unit 120, is located above the timed plane 192 at a height so as to detect the presence of the calf region of a player's leg over the out-of-bounds area. In a preferred embodiment, for example, the timed plane 192 is elevated above the playing surface 190 by one inch, and the shape plane 194 is elevated above the playing surface 190 by nine inches.

The timed plane 192 is so named because it comprises pulsed light beams which enable interferences in the light beams to be precisely detected and timed. Therefore, if a light beam interference is of a short duration, such as 10 milliseconds, then a ball is presumed to have caused the interference, otherwise the interference is ascribed to the slower moving body part of a player.

However, timed light beams may not be adequate alone for the case when a player interferes with the timed plane 192 and a ball passes through the same interfered light beam path, and where fast foot movements approach the speed of a slow ball. Thus, the shape plane 194, which, when interfered with by a player's leg, disables the timed plane 192 for a particular pair of sensor units 120, still allows the timed planes 192 associated with two other pairs of sensor units 120 to remain enabled. Note that because of the angular relationship of the beams, at least two pairs of sensors will not be interfered or disabled; thus, the two enabled pairs of sensors can still be used to detect the ball.

Figure 5:
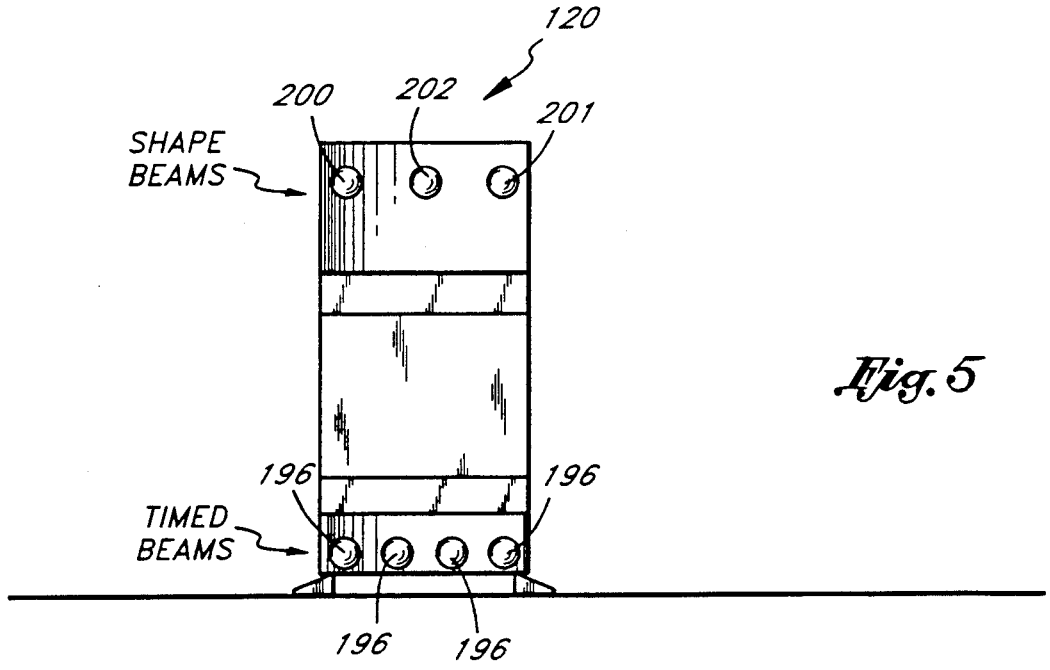
FIG. 5 is a front elevational view of one preferred embodiment of a sensor unit showing the locations of a plurality of collimating lenses used to focus shape and timed light beams.

FIG. 5 illustrates a front view of the preferred sensor unit 120 shown in FIG. 4. A plurality of timed plane apertures 196 are located at the bottom of the sensor unit 120. As was indicated previously, the timed plane apertures 196 must be spaced about 5 cm. apart, to optimize the boundary sensor system 100 for tennis. To maintain this relationship, when multiple sensor units 120 are used in an optical lattice 142 (FIG. 2), the sensor units 120 are configured so that adjacent units abut one another. A plurality of shape plane lenses 200, 201, 202 are located on the front face of the sensor unit 120 near the top. Since the size of the tennis players is much greater than the size of the tennis ball, less shape beams 224 than timed beams 222 are required for each pair of sensor units 120. Through experimentation, it has been shown that the ratio of timed light beams 222 to shape light beams 224 in each pair of sensor units 120 should be approximately 2:1.

When the sensor unit 120 is operated other than in an optical lattice 142, such as when the sensor unit is placed so that its beams run parallel and adjacent to the doubles sideline 108, only the pair of outer shape plane apertures 200, 201 are active. However, as was described above, the sensor units 120 are also designed to function as optical lattice sensor units 140 (FIG. 1) so as to define an optical lattice 142. Therefore, the sensor unit 120 has a concave front surface to provide for the horseshoe-like shape of the sensor unit configuration which defines the optical lattice 142. The sensor units 120 may thus be placed adjacent to one another inside of the playing surface perimeter 180, and surrounding the tennis court 102 in an optical lattice configuration 142. It is preferable that the shape plane apertures 200, 201, 202 not be vertically colinear with their associated timed plane apertures 196. Rather, the shape plane apertures 200, 201, 202 should be vertically offset from the timed plane apertures 196. This relationship is true because normally a player's leg will disable the timed plane 192 by first interfering one of the light beams of the shape plane 194. Thus, by the time the player's foot enters the timed plane 192, the light beams in the timed plane 192 have been disabled.

When the sensor units 140 are configured to produce the optical lattice 142 (FIG. 2), the outer shape plane apertures 200, 201 (FIG. 5) become impracticably close together because the sensor units 140 abut. As was discussed above, the optical lattice sensor units 140 are formed from adjacent sensor units 120, which are electronically coordinated. Thus, except for the sensor units 140 with only one neighboring sensor unit 140, the sensor units 140 are electronically coordinated by activating the circuitry (not shown) behind a central shape plane aperture 202 and deactivating one or both of the circuitries (not shown) behind the outer shape plane apertures 200, 201. As an example, if there were only two adjoining sensor units 140, one of the sensor units 140 would have the circuitries behind the outer shape plane aperture 200 and the central shape plane aperture 202 active. The other sensor unit 140 would have the circuitries behind the outer shape plane aperture 201 and the central shape plane aperture 202 active. The composite pair of sensor units 140 would provide eight timed plane beams 196. Thus, the outer shape plane apertures 200, 201 would control the enabling of the outer four timed plane beams 196, and the central shape plane apertures 202 would control the enabling of the inner four timed plane beams 196.

Figure 6:
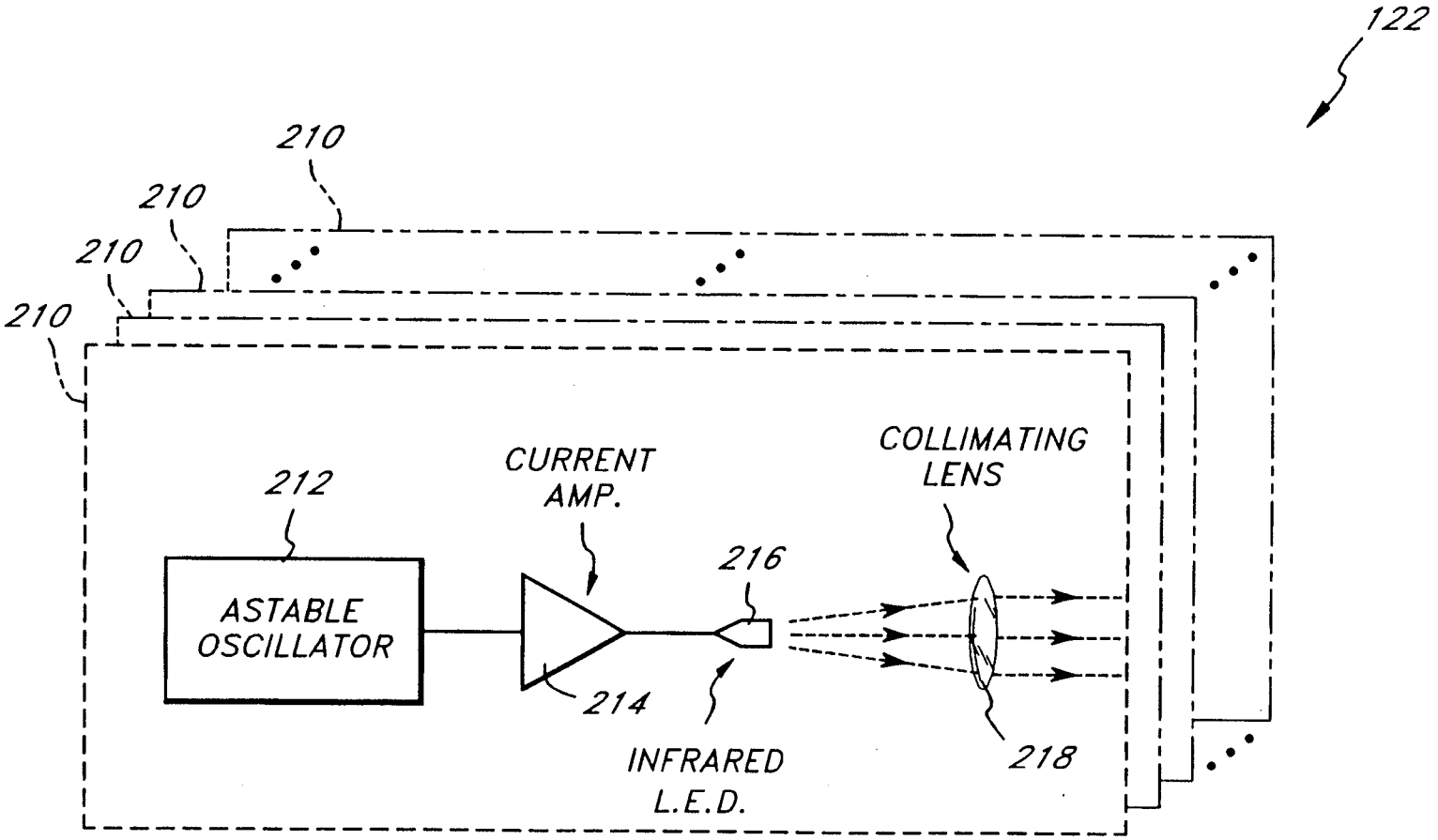
FIG. 6 is a block diagram of an emitter sensor unit circuit of the invention.

As was noted above, sensor units 120 operate in pairs. FIG. 6 illustrates the basic operation of the beam generation system of a preferred embodiment of the emitter sensor unit 122. The emitter sensor unit 122 comprises a plurality of beam generation circuits 210. One beam generation circuit 210 is provided for each beam to be generated by each of the individual emitter sensors in the unit 122. In the beam generation circuits 210, beams are pulsed by an astable oscillator 212. A typical pulse frequency will be about 50 kilohertz. The pulsing aids in the detection of the light beam by the receptor sensor unit 124 (FIG. 7) by creating a frequency which is easily distinguished over the background noise. The astable oscillators 212, for instance, may include a 555 timer, such as, for example, the μA555, manufactured by Fairchild Semiconductor Corporation of Sunnyvale, Calif. The output of the astable oscillator 212 is amplified by a current amplifier 214. The current amplifier 214 drives an infrared LED 216. The light beam emitted by the infrared LED 216 is focused by a collimating lens 218. The collimating lens 218 fits into one of the apertures 196, 200, 201, 202 on the emitter sensor unit 122. The operation of this circuit, and the component parts used therein, will be familiar to those skilled in the technology.

Figure 7:
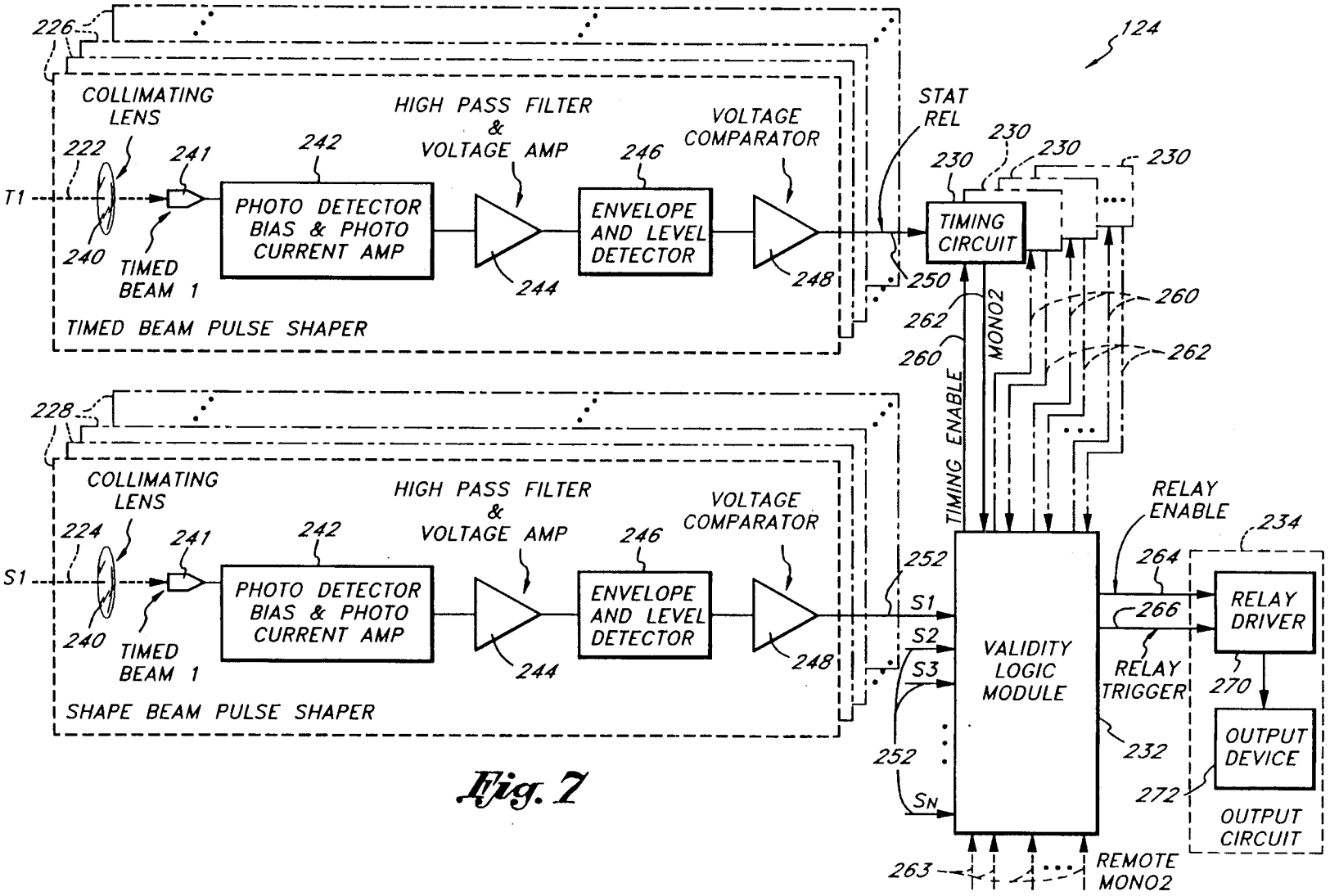
FIG. 7 is a block diagram of a receptor sensor unit circuit of the invention.

FIG. 7 illustrates the circuitry associated with the receptor sensor unit 124. The input to the receptor sensor unit 124 is a set of timed beams 222 and a set of shape beams 224 received from an associated emitter sensor unit 122. The receptor sensor unit 124 comprises five major functional units as follows: a set of timed beam pulse shapers 226, a set of shape beam pulse shapers 228, a set of timing circuits 230, a validity logic module 232, and an output circuit 234. The number of timed beam pulse shapers 226 and timing circuits 230 is equal and corresponds to the number of timed beams 222 generated by the LEDs 216 in the emitter sensor unit 122. Similarly, the number of shape beam pulse shapers 228 corresponds to the number of shape beams 224 generated by the LEDs 216 in the emitter sensor. unit 122. The final output of the receptor sensor unit 124 is simply an audiovisual indication that a ball is out-of-bounds.

The circuitries for the timed beam pulse shapers 226 and the shape beam pulse shapers 228 are essentially the same. Light enters the collimating lens 240 (located in one of the apertures 196, 200, 201, 202 of the receptor sensor unit) where the light is focused, and then is passed along to a phototransistor 241 to translate light energy into a small current. The small current output by the phototransistor 241 is amplified by a photodetector bias and photocurrent amplifier circuit 242. The photodetector bias and photocurrent amplifier circuit 242 can be easily assembled by one who is skilled in the technology. A high pass filter and voltage amplifier circuit 244 filters out the lower frequency signals from the output of the circuit 242, and amplifies the signal of interest. Lower frequency light signals form the white noise generated mainly by the sun. The signal of interest is the same frequency as that transmitted by the corresponding emitter sensor unit 122.

An envelope and level detector circuit 246 receives the signal output from the high pass filter and voltage amplifier circuit 244. The envelope and level detector circuit 246 averages randomness in the voltage of the input signal. The envelope and level detector circuit 246 can be assembled by one who is skilled in the technology from off-the-shelf parts such as, for example, an LM741, manufactured by National Semiconductor Corp., of Santa Clara, Calif.

The voltage output from the envelope and level detector circuit 246 is then transmitted to a voltage comparator 248 which compares this voltage against a reference voltage (not shown). If the voltage input to the voltage comparator 248 is lower than the reference voltage, then the voltage comparator 248 outputs a LOW voltage, typically represented by 0V. If the voltage input to the voltage comparator 248 is higher than the reference voltage, then the voltage comparator 248 outputs a HIGH voltage, typically represented by +5V.

The output of the pulse shapers 226 is a pulsed signal, called STAT REL. The timed beam pulse shapers 226 each transmit their output signals on one of the lines 250 to a corresponding timing circuit 230. The shape beam pulse shapers 228 each transmit their output signals on one of the lines 252 which carry the signals to the validity logic module 232. If a shape beam 224 which governs a particular timed beam 222 has not been interrupted, then the validity logic module 232 will produce a HIGH voltage on line 260, which is connected to the timing circuit 230, thereby enabling the timing circuit 230. Under these circumstances, if the associated timed beam 222 is not interrupted, the STAT REL signal on line 250 will be HIGH and no timing will occur in the timing circuit 230. However, if the timed beam 222 is interrupted under these circumstances, then the STAT REL signal on line 250 will be LOW, causing the timing circuit 230 to begin timing. As was indicated previously, if the interruption to timed beam 222 is caused by a limb of a player, this interruption should extend for a time period which is substantially longer than that of an interruption caused by a tennis ball. Thus, the timing circuit 230 functions, in a manner to be described hereinafter, to identify a short term interruption caused by a tennis ball and to produce an output signal (MONO2) on line 262 indicating whether the interference is caused by a tennis ball.

The validity logic module 232 receives the MONO2 signals on lines 262 from multiple timing circuit outputs. The validity logic module 232 also receives remote MONO2 signals on lines 263 from other sensor units 140, and determines if a ball bounce has been detected in at least two intersecting light beams (refer to FIGS. 2 and 3). If at least two timed beams 222 in one of the out-of-bounds protected areas 150 have been interfered, then a relay trigger signal in the validity logic module 232 goes HIGH. This relay trigger signal is communicated via line 266 to a relay driver 270 in the output circuit 234. A relay enable line 264 carries a relay enable signal from the validity logic module 232 to the relay driver 270 in the output circuit 234. If the shape beams 224 associated with the timed beams 222 have not been interfered, then the validity logic module 232 places an enable, HIGH voltage, signal on the relay enable line 264. When a HIGH relay trigger signal is present on line 266, and an enable or HIGH voltage signal is present on line 264, then the relay driver 270 takes the low voltage output from the relay trigger line 266, and drives a higher voltage output device 272. The output device 272 may be a buzzer, a light, a voice synthesizer, or any other like audio or visual signaling device, or combination thereof, used to announce the occurrence of an out-of-bounds condition.

Figure 8:
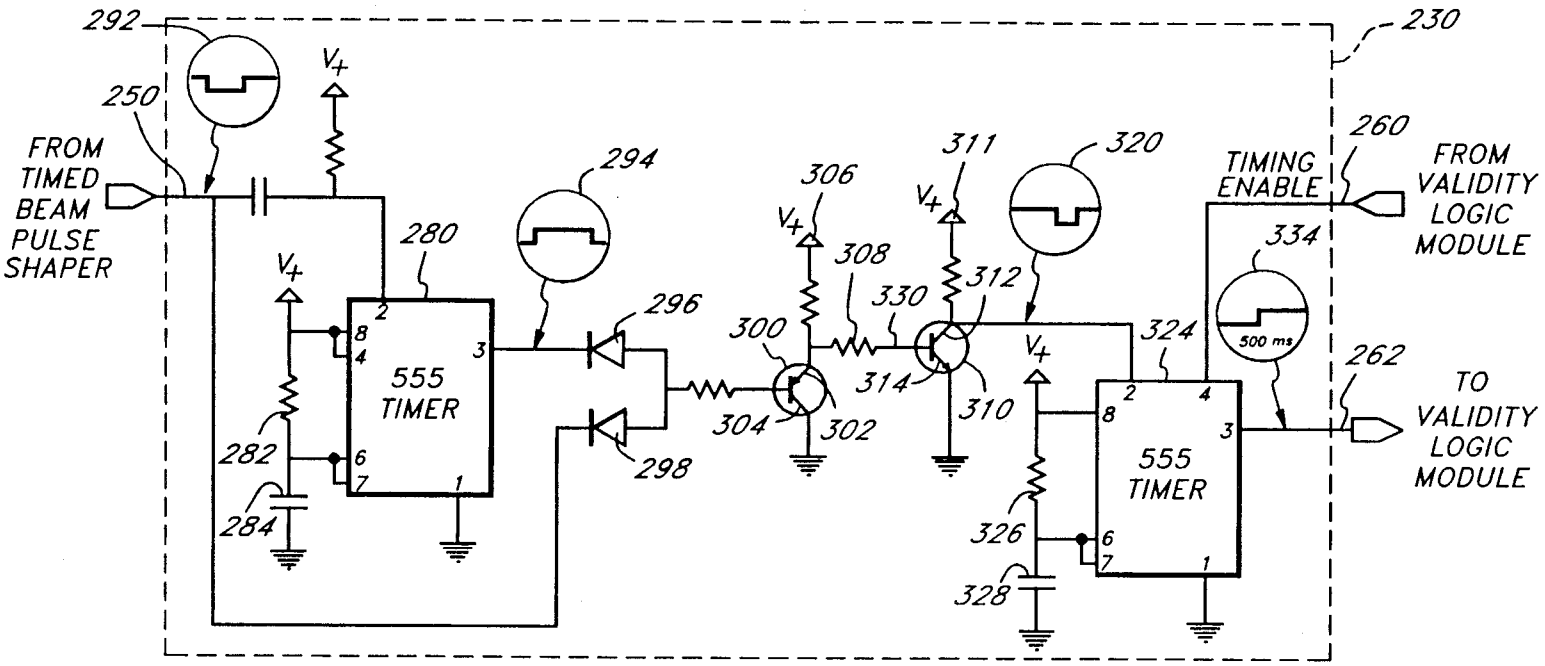
FIG. 8 is a schematic diagram of the timing circuit shown in FIG. 7.

The detailed implementation of one preferred embodiment of the timing circuit 230 can be more fully understood by referring to FIG. 8. The function of the timing circuit 230 is to determine if light interference in one of the timed beams 222 (FIG. 7) was caused by a player or a ball. In particular, the STAT REL signal from the timed beam pulse shaper 226 is transmitted via line 250 to an input Pin 2 of a conventional 555 timer 280. The 555 timer 280 receives power through Pin 8 and is grounded by Pin 1. The reset at Pin 4 is not used and is therefore tied HIGH. Pins 6 and 7 of the 555 timer 280 receive a short duration voltage from a resistor 282 and a capacitor 284. The duration, T, of the output of the 555 timer 280 is set to distinguish between a ball bounce and a player's foot, and T can be determined from the equation $T=1.1RC$, where R is the resistance of the resistor 282, and C is the capacitance of the capacitor 284. A typical value of T is, for example, 9.5 milliseconds. The period T, of course, must be chosen so as to be less than the typical duration of a foot interference caused by a player. For instance, if T is 9.5 ms., then an interference in one of the timed beams 222 lasting longer than T, say 10 ms., will be presumed to be caused by a player. The pulse of width T generated by the 555 timer 280 is negative-edge triggered through Pin 2 by STAT REL. During the time interval determined by the triggered RC circuit, a HIGH voltage signal is output on Pin 3.

Figure 9:
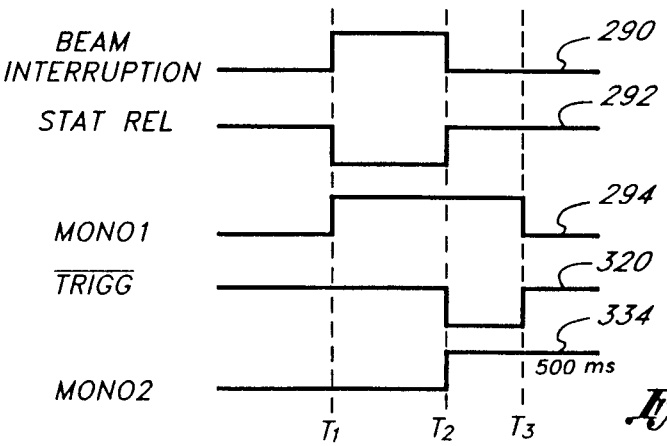
FIG. 9 is a timing diagram for the signals identified in the timing circuit shown in FIG. 8.

The operation of this portion of the timing circuit 230 is demonstrated by the timing diagram of FIG. 9. A beam interruption by a tennis ball is shown as beam interruption trace 290, which corresponds to a logic HIGH pulse. The STAT REL voltage waveform is represented by STAT REL trace 292, which indicates that the electrical signal is inverted by the timed beam pulse shaper 226 to be a LOW voltage during the interruption.

The 555 timer 280 triggers on a negative going input signal and, once triggered, the 555 timer 280 remains in a HIGH state until the time defined by the RC circuit 282, 284 has elapsed. The 555 timer 280 output is at Pin 3 and the signal is shown by the trace designated as MONOI 294 in FIG. 9.

Up until time T2, one of the signals, STAT REL 292 or MONOI 294 is LOW. Consequently, one of the diodes 296, 298 (FIG. 8) will be forward biased, thereby causing a PnP transistor 300 to remain active. When transistor 300 is active, current flows between an emitter 302 and a collector 304. The voltage drop between a voltage source 306 and a resistor 308, causes a nPn transistor 310 to be cutoff. Hence, a signal $TRIGG_{inv}$ 320 remains HIGH up until time T2. The signal $TRIGG_{inv}$ 320 enters a second 555 timer 324. The 555 timer 324 has an output pulse duration circuit, or RC circuit, defined by a resistor 326 and a capacitor 328 which functions in the same manner as the RC circuit 282, 284 already discussed.

Now, assuming that the duration of the beam interruption 290, and hence, STAT REL 292 is less than the pulse duration of MONOI 294, there will be a period of time, between time T2 and time T3 (FIG. 9), when STAT REL 292 and MONOI 294 will both be HIGH. During this period, the diodes 296, 298 are reverse biased causing the transistor 300 to be cutoff. In the cutoff state, the transistor 300 behaves as an open circuit between the emitter 302 and the collector 304, and, thus, current from the voltage source 306 flows to a base 330. Since the HIGH voltage at the base 330 causes the transistor 310 to be active, a LOW voltage is present at Pin 2 of the 555 timer 324 as represented by the TRIGGinv signal 320 (see trace 320 in FIG. 9, and the trace 320 illustrated in FIG. 8).

Assuming the 555 timer 324 has been enabled by a timing enable signal (not shown) on line 260, indicating that a player has not interfered an adjacent shape beam, the timer 324 produces a LOW to HIGH voltage transition in a MONO2 output signal 334 which is transmitted from Pin 3 onto line 262. Such a transition in the MONO2 signal 334 only occurs when a ball or a very fast foot movement causes the beam interruption 290. The output pulse MONO2 334 should be of sufficient duration to allow coincident pulses between sensor units 140 separated by some distance. A typical duration of the output pulse MONO2 334, for example, is 500 ms.

On the other hand, if the duration of the beam interruption 290, and hence, STAT REL 292 is greater than the pulse duration of MONOI 294, indicating the beam interruption 290 was caused by a player's foot, then STAT REL 292 transitions from LOW to HIGH after MONOI 294 goes LOW at time T3. In this case, the TRIGGinv signal 320 does not trigger the 555 timer 324, since the beam interruption 290 was more than likely caused by a player.

Figure 10:
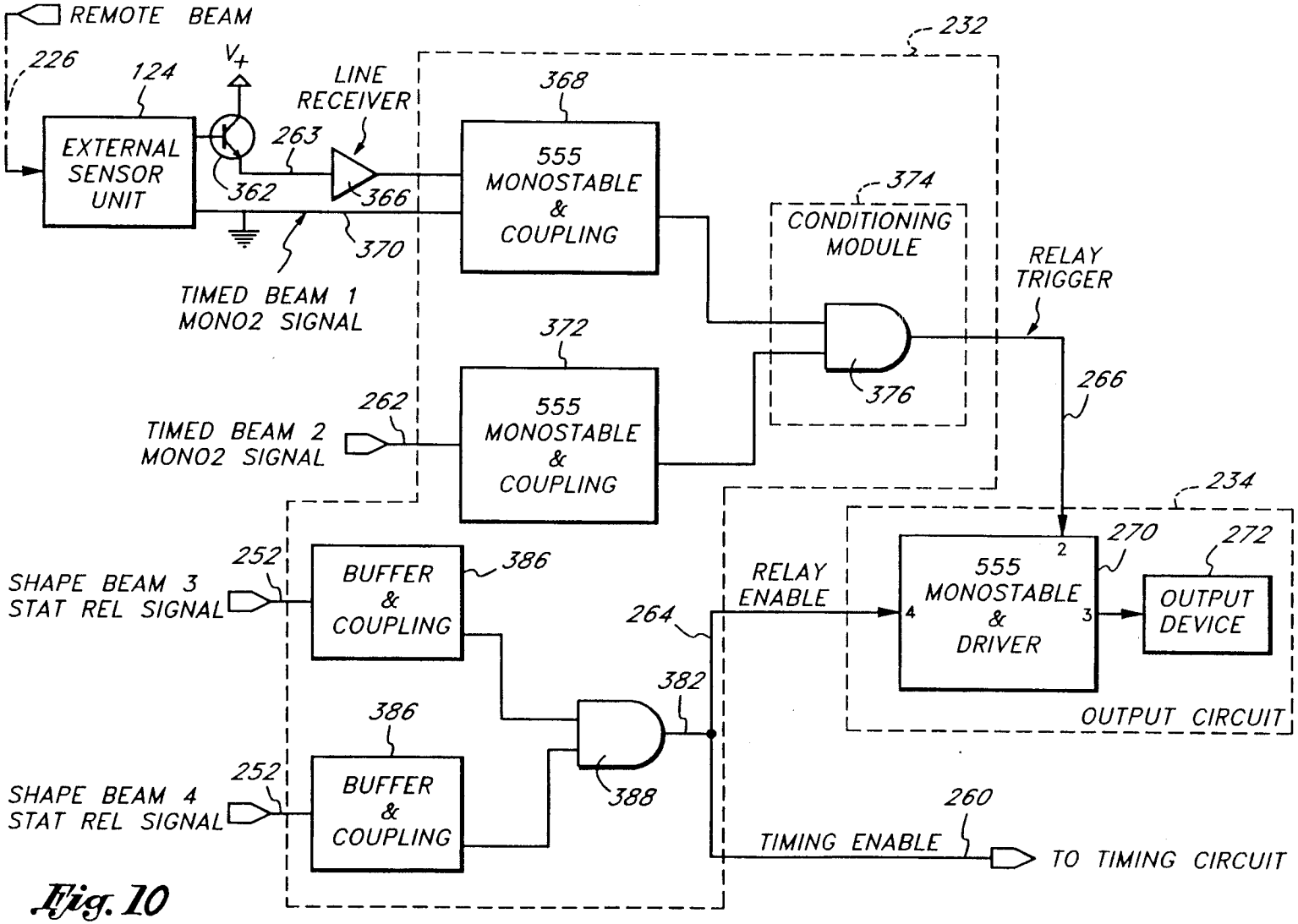
FIG. 10 is a schematic diagram of the validity logic module and the output circuit shown in FIG. 7.

A preferred embodiment of the validity logic module 232, referred to in FIG. 7, is shown in FIG. 10. In this example, only two timed beams 222 and two shape beams 224 will be considered as producing the signals which are received in the validity logic module 232 from the timed beam pulse shapers 226 and the shape beam pulse shapers 228. However, the validity logic module 232 can be easily extended to handle any number of timed and shape beams 222, 224.

A remote timed beam 226, that is, a beam lying in a different stripe of the optical lattice 142 from the sensor 140 where the validity logic module 232 resides (see FIG. 2), outputs a MONO2 signal (FIGS. 8 and 9) which is amplified by a line driver 362 included in an external receptor sensor unit 124. The MONO2 signal is amplified by a line driver 362, prior to transmission over a remote MONO2 line 263 to a line receiver 366 which is local to the validity logic module 232. The MONO2 signal from line 263 is again amplified by the line receiver 366.

Because the remote timed beam 226 may be some distance away, a need arises to compensate for a possible race condition between the remote timed beam 226 and a local timing circuit 230. Hence, a 555 monostable and coupling circuit 368 is connected to the line driver 362. The coupling circuit 368 includes, for example, an optical coupler such as a Motorola MCT2 or a Texas Instruments TIL111. A ground line 370 also connects the external receptor sensor unit 124 to the coupling circuit 368. The external receptor sensor unit 124 may be coupled to the validity logic module by, for example, a rainbow cable. Alternatively, more expensive coaxial cable could be used and, in this case, the ground 370 is also a shielding to prevent external electromagnetic signals from interfering with the remote timed beam 226. The output from the local timing circuit 230 is connected via line 262 to a second coupling and 555 monostable circuit 372.

The outputs of the coupling circuits 368, 372 are connected to a conditioning module 374. In this example, the logic of the conditioning module 374 is represented by a single AND gate 376. It is thus assumed that the remote timed beam 226 and the local timed beam (not shown) associated with the MONO2 line 262 intersect in the out-of-bounds protected area 150 (see FIG. 2). Of course, for a typical application, the logic of the conditioning module 374 will be much more complex, with the necessary logic for that module being constructed in accordance with the spirit of the logic table illustrated by FIG. 3.

The output of the conditioning module 374 is a relay trigger signal which is transmitted on line 266 to Pin 2 of a 555 monostable and driver circuit which forms the relay driver 270. With the presence of a relay trigger signal, the 555 monostable and driver circuit 270 is enabled by a relay enable signal received from line 264 onto Pin 4 of the 555 monostable and driver circuit 270. With the relay enable signal HIGH, and the relay trigger signal HIGH, the 555 monostable and driver circuit 270 produces a signal which is transmitted to the output device 272 producing a audio and/or visual alarm announcing an "out-of-bounds" condition.

The input signals from lines 252 are connected to a pair of buffer and coupling circuits 386. The buffer and coupling circuits 386 amplify signals which reflect interferences in the shape beams 384.

The outputs of the buffer and coupling circuits 386 are connected to an AND gate 388. Hence, only when both signals from lines 252 are HIGH, indicating that neither of the shape beams 224 have been interrupted, will the output circuit 234 be enabled by the relay enable signal from line 264. In a more typical application, for instance, in an optical lattice 142, only when two out of three shape beams 224 are not interfered, will the output circuit 234 be enabled. The relay driver 270, including a relay such as an AIRPAX 33A21D12, is provided with a small voltage and generates a larger voltage to power the output device 272.

In addition to the circuitry of the validity logic module 232 just described, more circuitry can be included to distinguish between a skidding ball and a player's foot. The circuitry to make such distinction was fully described by Chen, et al., (U.S. Pat. No. 4,004,805), which is hereby incorporated by reference herein. The Chen circuitry could be easily interfaced to the validity logic module 232 and made a part of the conditioning module 374.

Since the function of the validity logic module 232 depends on multiple sensor units 140, not all sensor units 140 require the validity logic module 232. The validity logic module 232 may, therefore, be placed in a master sensor unit, or it may be in a separate chassis with a power supply (not shown) at another location on the tennis court playing surface.

Thus, the present invention uses the combination of an optical timed plane and an optical shape plane to discriminate between an out-of-bounds player and an out of bounds ball. In addition, because of the unique optical lattice configuration of sensor units, interference of one light beam by a player does not negate coverage for out of bounds balls since, in general, two crossing timed beams of the optical lattice will still be operational. Consequently, the present invention provides accurate and consistent out-of-bounds calls for tennis games.

While the above detailed description has shown, described, and pointed out, the fundamental novel features of the invention as applied to various embodiments, it will be understood that various emissions and substitutions, and changes in the form and details of the device illustrated, may be made by those skilled in the art without departing from the spirit of the invention.

I claim:

1. A out-of-bounds sensor for ball courts defined by boundary lines comprising:

at least one first light emitter providing a first light beam substantially parallel to a boundary line;

at least one first light receptor which is collinear to said first light beam for receiving said first light beam;

at least one second light emitter providing a second light beam substantially parallel to said first light beam, wherein said second light beam is elevated above said first light beam for disabling said first light emitter when said second light beam is interfered;

at least one second light receptor which is collinear to said second light for receiving said second light beam; and at least one timing circuit coupled to said first light receptor for determining the duration of interference in said first light beam;

wherein said first light emitter and said first receptor are a plurality of light emitters and receptors providing the first light beam as substantially parallel light beams forming a first plane parallel to a surface of said ball court, and wherein said second light emitter and said second receptor are a plurality of light emitters and receptors providing the second light beam as substantially parallel light beams forming a second plane parallel to and above said first plane.

2. A sensor as defined in claim 1, additionally comprising means for signaling a human that said first light beam is interfered.

3. A sensor as defined in claim 1, wherein at least one of said first and second light beams is pulsed.

4. A sensor as defined in claim 1, additionally comprising at least one collimated lens to focus at least one of said first and second light beams.

5. A sensor as defined in claim 1, additionally comprising means for detecting a sequence of interferences in said first light beams to ascertain when a ball skids across a boundary line.

6. A sensor as defined in claim 1, wherein the ratio of the number of said first light beams to the number of said second light beams is approximately two to one.

7. A sensor as defined in claim 1, wherein the separation between said light beams in said first light plane is less than the diameter of a tennis ball.

8. A sensor as defined in claim 1, wherein at least one of said first an second light receptors is a phototransistor.

9. A sensor as defined in claim 1, wherein at least one of said first and second light emitters is a laser.

10. A sensor as defined in claim 1, wherein at least one of said first and second light emitters is a light emitting diode.

11. A sensor as defined in claim 1, wherein at least one of said first and second light beams is transmitted in the infrared frequency band.

12. An out-of-bounds system for a tennis court, comprising:

means for generating a timed light beam;

means located collinear to said timed light beam for detecting when said timed light beam is interfered;

means coupled to said detecting means for discriminating between a human interference and a ball interference;

means for generating a shape light beam wherein said shape light beam is substantially parallel to said timed light beam and elevated therefrom;

means located collinear to said shape light beam for detecting when said shape beam is interfered; and means for disabling said timed light beam generating means only when said shape light beam has been interfered;

wherein said first and shape light beam generating and detecting means and said disabling means are configured such that, for a tennis court line, said timed light beam includes at least three intersecting timed light beams, wherein a first timed light beam intersects said tennis court line, and a second timed light beam intersects said tennis court line and further intersects said first timed beam, and a third timed beam located substantially parallel and outside of said boundary line intersects said first timed beam at substantially the same point where said first and second timed beams intersect.

13. A system as defined in claim 12, additionally comprising:

means coupled to said timed light beam generating means for determining an out-of-bounds condition for a tennis ball when said detecting means detects interference at an intersection of at least two of said timed light beams outside of said tennis court.

14. A system as defined in claim 13, additionally comprising:

means coupled to said determining means for displaying said interference at said intersection audiovisually.

15. A system as defined in claim 14, wherein said display means comprises:

circuit means for pulse generation and driving; and an audiovisual output device coupled to said pulse generation and driving means.

16. A system as defined in claim 15, wherein said output device is a voice synthesizer.

17. A system as defined in claim 13, wherein said determining means comprises:

means for electro-optical coupling and pulse generation coupled to said timing means;

means for buffering and electro-optical coupling coupled to said shape light beam detecting means; and means coupled to said electro-optical coupling said pulse generation means for determining whether two of said three intersecting sets of lights are interfered and whether said intersection is out-of-bounds.

18. A system as defined in claim 12, wherein said timed beam generating and detecting means is a plurality of said means providing substantially parallel light beams forming a first plane substantially parallel to a surface of said tennis court.

19. A system as defined in claim 18, wherein said shape beam generating and detecting means is a plurality of said means providing substantially parallel light beams forming a second plane substantially parallel to and above said first plane.

20. A system as defined in claim 12, wherein said timed light beam detecting means is a pulse shaper circuit.

21. A system as defined in claim 12, wherein said timed light beam generating means comprises:

means for generating a first predefined pulse width triggered after a timed light beam is first interfered;

means coupled to said generating means for comparing the duration of said predefined pulse and a pulse corresponding to said interference; and means coupled to said comparing circuit means for generating a second predefined pulse.

22. A system as defined in claim 12, wherein said shape light beam detecting means is a pulse shaper circuit.

23. An out-of-bounds system for a tennis court, comprising:

means for generating a timed light beam;

means located collinear to said timed light beam for detecting when said timed light beam is interfered;

means coupled to said detecting means for discriminating between a human interference and a ball interference;

means for generating a shape light beam;

means located collinear to said shape light beam for detecting when said shape beam is interfered;

means for disabling said timed light beam generating means only when said shape light beam has been interfered, wherein said timed and shape light beam geneating and detecting means and said disabling mean are configured such that, for a tennis court line, said timed light beam includes at least three intersecting timed light beams, wherein a first timed light beam intersects said tennis court line, and a second timed beam intersects said tennis court line, and a second timed light beam intersects said tennis court line and further intersects said first timed beam, and a third timed beam located substantially parallel and outside of said boundary line intersects said first timed beam at substantially the same point where said first and second timed beams intersect;

means coupled to said timed light beam generating means for determining an out-of-bounds condition for a tennis ball when said timing means detects interference at an intersection of at least two of said timed light beams outside of said tennis court; and means coupled to said determining means for displaying said interference at said intersection.

24. A system as defined in claim 23, wherein said display means comprises:

circuit means for pulse generation and driving; and an output device coupled to said pulse generation and driving means.

25. A system as defined in claim 24, wherein said output device is a voice synthesizer.

26. An out-of-bounds system for a tennis court, comprising:

means for generating a timed light beam;

means located collinear to said timed light beam for detecting when said timed light beam is interfered;

means coupled to said detecting means for discriminating between a human interference and a ball interference;

means for generating a shape light beam;

means located collinear to said shape light beam for detecting when said shape beam is interfered;

means for disabling said timed light beam generating means only when said shape light beam has been interfered, wherein said timed and shaped light beam generating and detecting means and said disabling means are configured such that, for a tennis court line, said timed light beam includes at least three intersecting timed light beams, wherein a first timed light beam intersects said tennis court line, and a second timed light beam intersects said tennis court line and further intersects said first timed beam, and a third timed beam located substantially parallel and outside of said boundary line intersects said first timed beam at substantially the same point where said first and second timed beams intersect; and means coupled to said timed light beam detecting means for determining an out-of-bounds condition for a tennis ball when said timed light beam detecting means detects interference at an intersection of at least two of said timed light beams outside of said tennis court, wherein said determining means comprises:

means for electro-optical coupling and pulse generation coupled to said timed light beam detecting means; and means for buffering, electro-optical coupling and pulse generation coupled to said shape light beam detecting means for determining whether two of said three intersecting sets of lights are interfered and whether said intersection is out-of-bounds.

* * * * *